United States Patent [19]

Current

[11] 4,203,518

[45] May 20, 1980

[54] PACKAGE FOR SEWING MACHINE NEEDLES

[75] Inventor: Wayne A. Current, Holmdel, N.J.

[73] Assignee: The Singer Company, Stamford, Conn.

[21] Appl. No.: 19,064

[22] Filed: Mar. 9, 1979

[51] Int. Cl.[2] ..... B65D 85/24

[52] U.S. Cl. ..... 206/380; 206/534; 206/533

[58] Field of Search ..... 206/380, 532, 533, 534, 206/538, 443; 220/20

[56] References Cited

U.S. PATENT DOCUMENTS

| | | | |
|---|---|---|---|
| 2,573,311 | 10/1951 | Cupler | 206/380 |
| 3,482,728 | 12/1969 | Flax | 220/20 |
| 3,557,747 | 1/1971 | Rigney | 206/533 |
| 3,638,830 | 2/1972 | Belokin | 206/533 |
| 4,083,452 | 4/1978 | Rossino | 206/533 |
| 4,124,143 | 11/1978 | Thomas | 206/534 |

FOREIGN PATENT DOCUMENTS

| | | | |
|---|---|---|---|
| 706228 | 3/1965 | Canada | 206/534 |

*Primary Examiner*—Herbert F. Ross

*Attorney, Agent, or Firm*—Edward L. Bell; Robert E. Smith; Michael H. Wallach

[57] ABSTRACT

A package for retaining sewing machine needles in a plurality of compartments. Means are provided for selecting a needle stored in a compartment by rotating a base containing a dispensing slot until the slot is aligned with an aperture of the desired needle compartment. An information disc, containing needle selection information, is interposed between the compartments and the base. Needle data may be read through an aperture or frame contained on the base, thereby advising the sewer of the appropriate uses for the needles contained within the selected compartment.

4 Claims, 2 Drawing Figures

PACKAGE FOR SEWING MACHINE NEEDLES

BACKGROUND OF THE INVENTION

1. Field of the Invention

This invention relates to a package for retaining and dispensing sewing machine needles.

2. Description of the Prior Art

Sewing machines require a variety of needles of different sizes and construction to efficiently perform the sewing process. A needle best suited to one type of sewing operation or material may not be optimum for another type of operation or material. It is therefore advantageous to have a variety of needles available while sewing which are retained in a convenient location so that they are readily accessible should they be needed.

One problem with prior known needle packages is that the needles are not segregated by types or size.

Another problem is that the package does not contain information on the selection of a correct needle for varying types and weights of fabric and thread.

Still another problem is that some prior known needle packages do not permit individual acces to one of several needle compartments at a time.

SUMMARY OF THE INVENTION

It is an object of this invention to provide a package for sewing machine needles in which the needles can be segregated in individual compartments.

It is also an object of this invention to provide a package for sewing machine needles in which information concerning the proper choice of needles for a particular thread or fabric is selectively displayed as a consequence of choosing a particular needle compartment.

It is another object of this invention to provide a package for sewing machine needles in which individual storage compartments can be selectively accessed.

The above objects and other advantages are achieved in a needle package formed by rotatably fastening a storage disc containing a plurality of storage compartments to a base member. The storage disc has a hub containing an aperture formed at its center which receives a set of tangs which project from the center of a base. A plurality of walls radiate outwardly from the hub and define needle storage compartments. Each wall has an arcuate segment formed at the extremity opposite the hub which thereby define a set of end walls for each storage compartment. The radial extremity of the base is formed with an upstanding base wall which overlies the arcuate segments and encloses the storage compartments. The base wall contains a dispensing slot which may be rotated into alignment with any of the storage compartments to allow the contents of the selected compartment to be removed. The base also contains a plurality of detents which receive projections carried on the arcuate wall segments to aid in aligning the dispensing slot with the needle storage compartment apertures. An information disc, containing sectors of information on the size and application of the contents of each storage compartment, is interposed between the storage disc and the base. The base has formed therein an aperture or frame which aligns with the appropriate sector on the information disc to permit the display of information on the needles whose storage compartment is exposed.

BRIEF DESCRIPTION OF THE DRAWINGS

The above and other objects of this invention will become evident from a full and complete understanding of the preferred embodiment which is hereinafter set forth in such detail as to enable those skilled in the art to readily understand the function, operation, construction and advantages of it when read in conjunction with the accompanying drawings in which.

DESCRIPTION OF THE PREFERRED EMBODIMENT

Figure 1:
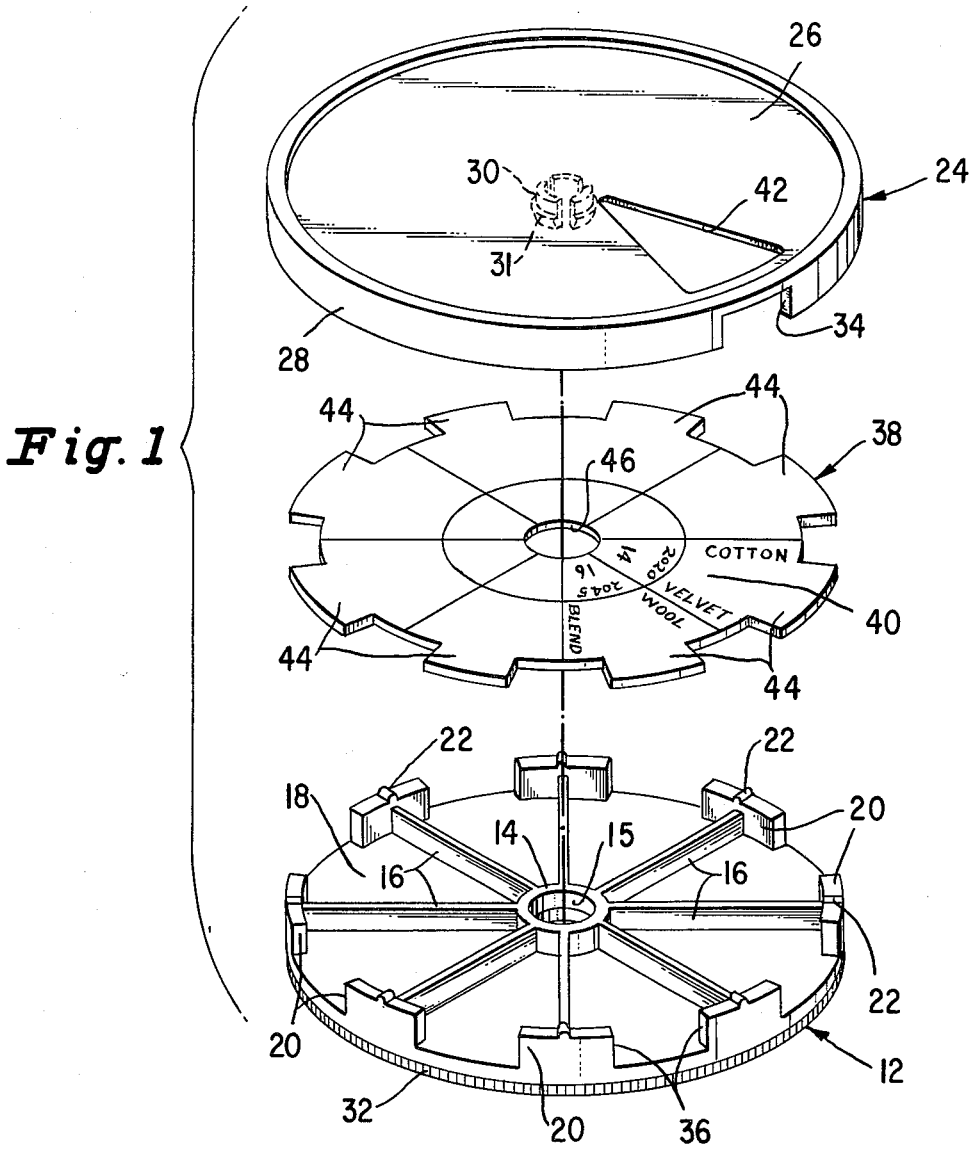
FIG. 1 is a disassembled perspective view of a sewing machine needle package constructed in accordance with the teachings of this invention.

Referring to the drawings, FIG. 1 shows a package for sewing machine needles having a circular storage disc 12. A hub 14 rises from the center of the storage disc 12 and contains an aperture 15 passing therethrough. Radiating from the hub 14 are a plurality of walls 16 which define the sides of a plurality of needle storage compartments 18. The outer extremity of each of the walls 16 terminate in an arcuate segment 20 which, together with the walls 16, define the needle storage compartments 18.

Figure 2:
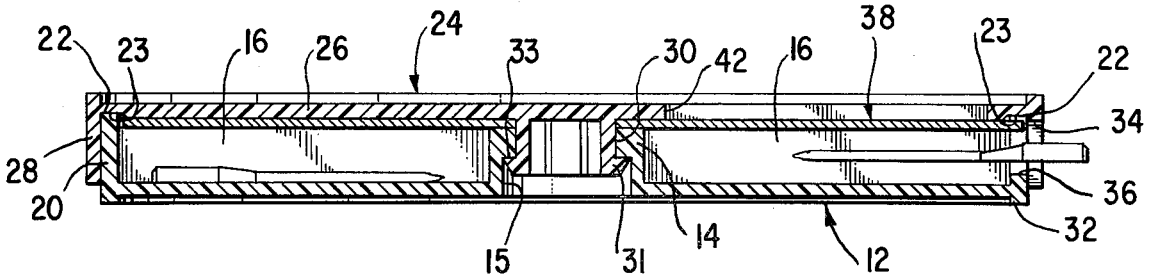
FIG. 2 is a side plan view of the needle package.

A base 24 having a circular surface 26 and a cylindrical base wall 28 rising from the radial extremity of the surface 26 are adapted to enclose the needle storage compartments 18 so that the base wall 28 resides outside of the arcuate segments 20. The base surface 26 has projecting from the center thereof a set of upstanding tangs 30 having projections 31 which are received within the aperture 15, thereby coaxially locating the base 24 with respect to the storage disc 12, and permitting the base 24 to rotate about the storage disc 12. FIG. 2 shows that the projections 31 radiate from the tangs 30 and pass through the aperture 15 to lock the base 24 to the storage disc 12 by engaging a rib 33 in the aperture 15, while permitting the base 24 to rotate about the storage disc 12. Preferably the storage disc 12 has a toothed edge 32 to facilitate grasping the storage disc 12 when it is rotated about the base 24.

The base wall 28 has a dispensing slot 34 formed therein which is positioned to align with a plurality of aperture 26 formed between the adjacent arcuate segments 20. The apertures 36 allow the insertion and removal of needles into and out of the storage compartments 18. It will be understood that when the base 24 is fastened to the storage disc 12, the base wall 28 encircles and encloses the arcuate segments 20, thereby closing the apertures 36. It will be apparent that by rotating the base 24 relative to the disc 12, the dispensing slot 34 may be selectively aligned with any of the apertures 36, thereby allowing access to the contents of a specific needle storage compartment 18. It will also be apparent that by rotating the base 24 relative to the disc 12 so that the dispensing slot 34 is aligned with any arcuate segment 20, the slot 34 will be closed off, thereby restraining the contents of each of the storage compartments 18.

FIG. 2 shows the arcuate segments 20 each have a projection 22 rising therefrom. A series of recesses 23 are formed about the base 24 so that the projections 22 are coaxial with the recesses 23. It will be appreciate that as the storage disc 12 is rotated about the base 24, the projections 22 will periodically align with recesses 23. When the projections 22 are aligned with the recesses 23 there will be a resistance imposed to the movement of the storage disc 12 with respect to the base 24, thereby reducing the potential for the unwanted spillage of needles from the storage compartments 18.

It will be appreciated by one skilled in the art of sewing that a variety of different needles should be available to optimally work with the different types and weights of fabrics and threads that a proficient sewer will contend with. To that end it will be recognized that is is desirable to have information available on the specific applications for which various needles are best suited. Means for conveying the appropriate information to a sewing machine operator are achieved by an information disc 38 which is interposed between the storage disc 12 and the base 24. The information disc contains a plurality of information sectors 40, the disc 38 having one sector 40 for each storage compartment 18 contained on the storage disc 12. Preferably the information sectors 40 each contain printed comments and suggestions on the suitable applications for the needles contained in the associated storage compartments 18. The base surface 26 has an information aperture or frame 42 formed thereon, through which the printed material contained in the information sector 40 may be viewed. It will be understood that as the base 24 is rotated relative to the storage disc 12, the information aperture 42 will expose the appropriate information sector 40 corresponding to the storage compartment 18 with which the dispensing slot 34 is aligned.

FIG. 2 shows that the information disc 38 is restrained from rotation about the hub 14 by a plurality of extension tabs 44 which radiate outwardly from the disc 38 and reside between the arcuate segments 20. The disc 38 rests on top of the walls 16 with the tangs 30 passing through an aperture 46 in the center of the disc 38. The disc 38 thereby acts as a cover for the needle storage compartments 18.

Modifications and variations of the above described preferred embodiment may become evident to one skilled in the relevant art in light of the above teachings. It is to be understood that modifications may be made to the preferred embodiment without departing from the spirit and scope of the invention as defined in the appended claims.

I claim:

1. A storage package for sewing machine needles comprising a circular storage disc having a hub containing an aperture passing therethrough formed at the center of said disc and extending perpendicular to said disc; a plurality of walls defining needle storage compartments rising from said circular storage disc and radiating from said hub; arcuate segments formed at the extremity of each of said walls and rising from said circular storage disc a short distance above said walls for defining an extremity of said needle storage compartments and spaced apart peripherally to define access dispensing openings to each of said compartments; an information disc having information sectors containing written needle information corresponding to the contents of respective compartments, said information disc overlying said needle storage compartments and contracting each of said walls and comprising radiating tabs disposed within said openings and abutting said arcuate segments for restraining said information disc from rotation about said hub so that said information disc remains stationary on said storage disc, said information disc having a thickness not greater than the difference of height of said walls and said segments; a base having a circular surface with a center; a base wall rising perpendicular from said base and encircling said base, said base wall having a dispensing slot formed therethrough for cooperation with said arcuate segments of said needle storage compartments to selectively provide a passageway into and out of a selected one of said needle storage compartments upon rotation of said base; an information aperture on said circular surface of said base for selectively exposing the associated one of said information sectors of said information disc upon rotation of said base to open a selected one of said compartments; and means for securing said base in said aperture in said hub.

2. The arrangement as set forth in claim 1 wherein said base has at least one recess formed therein and said arcuate wall segments of said storage disc have at least one projection formed thereon; said at least one projection aligning with said at least one recess and being restrained thereby to aid in retaining said apertures of said needle storage compartments in either an open or a closed position with respect to said dispensing slot contained on said base wall.

3. The arrangement as set forth in claim 1 wherein said means for securing said base to said hub comprises at least one upstanding tang having a projection radiating therefrom rising from the center of said base surface and being rotatably received by a rib formed in said aperture of said storage disc hub, said projection preventing said base from separating from said storage disc but allowing rotation of said base about said storage disc.

4. The arrangement as set forth in claim 3 wherein said at least one upstanding tang is of arcuate configuration and is resilient relative said base so that said base and said disc may be snap-fitted together.

* * * * *